US006388430B1

(12) United States Patent
Eldridge

(10) Patent No.: US 6,388,430 B1
(45) Date of Patent: May 14, 2002

(54) BUCK REGULATOR CIRCUIT FOR USE IN A POWER SUPPLY

(75) Inventor: Richard Allen Eldridge, Florence, SC (US)

(73) Assignee: The ESAB Group, Inc., Florence, SC (US)

( * ) Notice: Subject to any disclaimer, the term of this patent is extended or adjusted under 35 U.S.C. 154(b) by 0 days.

(21) Appl. No.: 09/952,222

(22) Filed: Sep. 13, 2001

(51) Int. Cl.[7] ..... G05F 1/14; G05F 1/24; G05F 3/04

(52) U.S. Cl. ..... 323/255; 323/259; 323/305

(58) Field of Search ..... 323/247, 255, 323/259, 305

(56) References Cited

U.S. PATENT DOCUMENTS

| | | | | | |
|---|---|---|---|---|---|
| 3,475,675 | A | | 10/1969 | Raposa | |
| 3,496,444 | A | | 2/1970 | King et al. | |
| 3,886,436 | A | | 5/1975 | Wadlington | |
| 4,203,040 | A | * | 5/1980 | Abbondanti et al. | 307/65 |
| 4,307,440 | A | | 12/1981 | Inoue et al. | |
| 4,591,966 | A | * | 5/1986 | Smith | 363/91 |
| 4,716,357 | A | | 12/1987 | Cooper | |
| 4,811,184 | A | | 3/1989 | Koninsky et al. | |
| 4,916,329 | A | | 4/1990 | Dang et al. | |
| 4,961,048 | A | | 10/1990 | Banura | |
| 5,001,413 | A | | 3/1991 | Ohms | |
| 5,144,222 | A | | 9/1992 | Herbert | |
| 5,430,641 | A | | 7/1995 | Kates | |
| 5,479,333 | A | | 12/1995 | McCambridge et al. | |
| 5,481,449 | A | | 1/1996 | Kheraluwala et al. | |
| 5,488,554 | A | * | 1/1996 | Green | 363/25 |
| 5,559,684 | A | * | 9/1996 | Ohms et al. | 363/25 |
| 5,747,972 | A | | 5/1998 | Baretich et al. | |
| 6,020,726 | A | | 2/2000 | James | |

* cited by examiner

*Primary Examiner*—Bao Q. Vu
(74) *Attorney, Agent, or Firm*—Alston & Bird LLP

(57) ABSTRACT

The present invention provides a modified buck regulator circuit capable of providing two output voltage levels. The circuit includes an inductive element connected between the input and output of the circuit. Further, the circuit includes an auto-transformer and two switches creating separate current paths with a load connected to the output of the circuit. In one mode, the switches are operated in parallel to provide a first voltage across the load. Because the switches are in parallel with respect to each other, the load current is divided between the two switches. In a second mode, the switches are operated in a push-pull mode. In this mode, the auto-transformer steps down the load voltage and also effectively steps down the current across each switch. As such, the buck regulator circuit of the present invention may provide two separate voltages, while also reducing the current across the switches of the buck regulator circuit.

17 Claims, 4 Drawing Sheets

BUCK REGULATOR CIRCUIT FOR USE IN A POWER SUPPLY

FIELD OF THE INVENTION

The present invention relates generally to regulator/converter circuits for use in power supplies and more specifically, to a buck regulator/converter circuit that is capable of providing at least two different output voltage levels.

BACKGROUND OF THE INVENTION

A large number of machinery use DC voltage for operation. The DC voltage may be supplied either by a battery or by an AC power source that has been stepped down by a transformer and rectified by a diode bridge. Because voltage from a battery or rectifier bridge is fixed and unregulated, many systems also include a DC-to-DC regulator/converter intermediate between the power source and the rest of the machinery. The DC-to-DC regulator/converter regulates/converts the unregulated power from the battery or rectifier bridge into a regulated DC power source for use by the machinery. The DC-to-DC regulator/converter may also decrease or increase the voltage output by the DC-to-DC converter.

As an example, many welding and cutting systems use an AC voltage source for power. The AC voltage source is rectified and provided to a DC-to-DC regulator/converter. The DC-to-DC regulator/converter regulates the voltage and provides a controlled output DC voltage for use in the welding or cutting system to initiate and maintain the welding or cutting process.

A common DC-to-DC regulator/converter used in the industry is referred to as a "buck" regulator. A buck regulator typically not only regulates the ripple in the DC output, but it also steps down the DC output voltage level from that of the voltage input into the buck regulator. With reference to FIG. 1, a conventional buck regulator 10 typically includes positive and negative input terminals, 12*a* and 12*b*, respectively, connected to either a battery or a rectifier bridge and AC power, not shown. The regulator further also includes positive and negative load terminals, 14*a* and 14*b*, respectively, connected across a load, not shown. Connected to the positive terminal 12*a* is a switch $Q_B$ for regulating the voltage output by the regulator. The buck regulator also includes a freewheeling diode $D_B$, an inductor $L_B$, and a capacitor $C_B$.

In operation, the switch $Q_B$ is alternately switched between "on" and "off" states. In the "on" state, power from the input source is provided to the load. In the "off" state, current flows from the charged inductor $L_B$ through the load and the freewheeling diode. This configuration regulates the load voltage and steps down the input voltage before it is applied to the load.

Although conventional Buck regulators/converters, such as the one illustrated in FIG. 1, typically provide acceptable regulated DC voltage outputs for most machinery, there are some drawbacks with many conventional buck regulator/converter designs. One problem is the use of only one switch for power regulation. As illustrated in FIG. 1, the entire load current in the regulator/converter is conducted through the switch $Q_B$ when the switch is in the "on" state. As such, in applications in which the load current is at a relatively high level, the switch may be deleteriously affected. Due to the increased current requirements, a higher rated, more costly switch must be used for high current level applications. This, in turn, may increase the overall cost of the machinery in which the buck regulator circuit is implemented.

Another noted problem is that conventional buck regulator circuits are typically designed to output only one particular voltage level, as opposed to a range of voltage levels. Some applications, however, could benefit from use of more than one voltage level. For example, in a welding or cutting system, typically a higher voltage level is needed to initiate a welding or cutting process, but only a lower voltage level is required to maintain the welding or cutting process, once initiated. However, because conventional buck regulators are only designed for one voltage output, conventional welding or cutting systems typically design the buck regulator to output the maximum voltage needed for initiating welding or cutting and use this same voltage for the entire process. As such, use of conventional buck regulators having only one voltage output may be energy inefficient.

SUMMARY OF THE INVENTION

As set forth below, the present invention provides a modified buck regulator circuit that overcomes many of the deficiencies associated with providing regulated DC power to machinery. In particular, the present invention provides a modified buck regulator/converter that reduces the peak current across the switch. The present invention also allows for the output of different voltage levels, to provide a more energy efficient system.

For example, in one embodiment, the present invention provides a buck regulator circuit comprising positive and negative input terminals for connection to a DC source, such as either a battery or a transformer and bridge rectifier. The circuit further includes positive and negative load terminals for connection to a load. Connected between the positive and negative terminals is an inductive element. Further, and importantly, the buck regulator circuit includes an auto-transformer having first and second end taps and an intermediate tap. The intermediate tap is connected to the negative load terminal. Connected to each of the first and second end taps of the auto-transformer are respective first and second switches. The switches are also connected to the negative input terminal of the circuit. Further, first and second diodes are also connected respectively between the first and second end taps and the positive load terminal.

In operation, the switches may be operated in either a parallel or push-pull mode. In a parallel mode in which the switches are switched to the "on" state at the same time and "off" state at the same time, the buck regulator of the present invention provides a first voltage level across the positive and negative load terminals. Further, because the two switches are in parallel with one another, the current flowing through the load is divided between the two switches. As such, each switch is not required to handle all of the current across the load. Thus, lower cost switches having lower current ratings may be used in the buck regulator of the present invention, as opposed to conventional buck regulator circuits.

Alternatively, operating the switches in a push-pull mode also provides several advantages. Specifically, when operated in this configuration, the buck regulator circuit of the present invention provides a second output voltage across the load that is less than the first voltage provided in the parallel mode configuration. Further, the buck regulator circuit in the push-pull mode also decreases the current through each switch.

Specifically in the push-pull mode, the first and second switches are alternately switched between "on" and "off" states, such that when one switch is "on" at a given time the other switch is "off." When each switch is switched to an "on" state, the auto-transformer steps down the current by approximately one half of the load current, such that the switch only receives half the current. Further, and importantly, the auto-transformer also steps down the voltage across the load to provide a voltage that is approximately one-half the voltage provided across the load during parallel mode operation of the switches.

As such, depending on whether the switches of the present invention are operated in a parallel or push-pull operation, the buck regulator circuit of the present invention may provide two separate voltages. Further, in either mode, the current across the switches is less than that of conventional circuits that use only one switch.

BRIEF DESCRIPTION OF THE DRAWINGS

Figure 1:
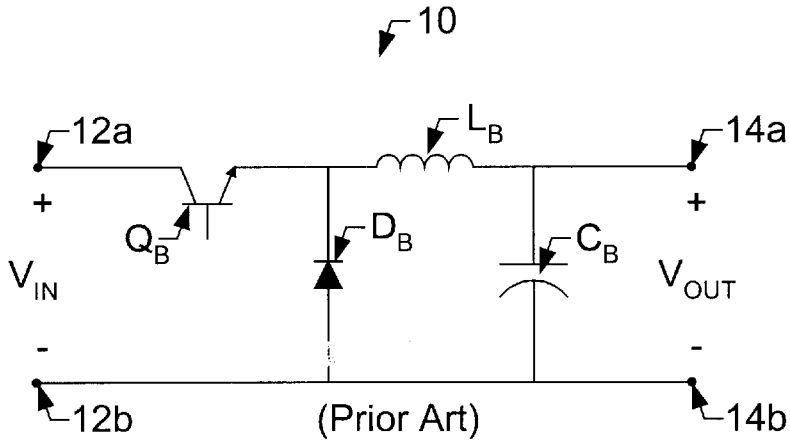

Having thus described the invention in general terms, reference will now be made to the accompanying drawings, which are not necessarily drawn to scale, and wherein:

FIG. 1 is a schematic depiction of a conventional buck regulator circuit.

Figure 2:
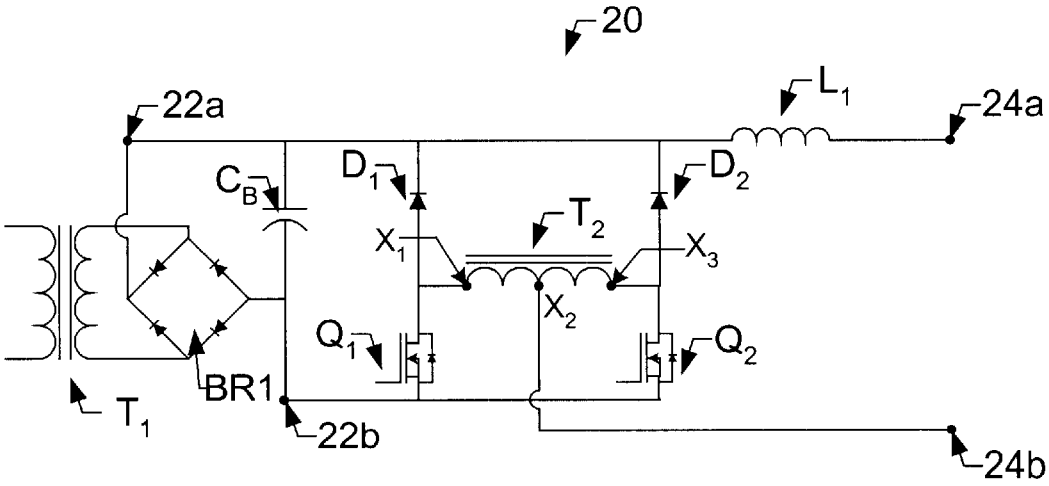

FIG. 2 is a schematic depiction of a buck regulator according to one embodiment of the present invention.

Figure 3A:
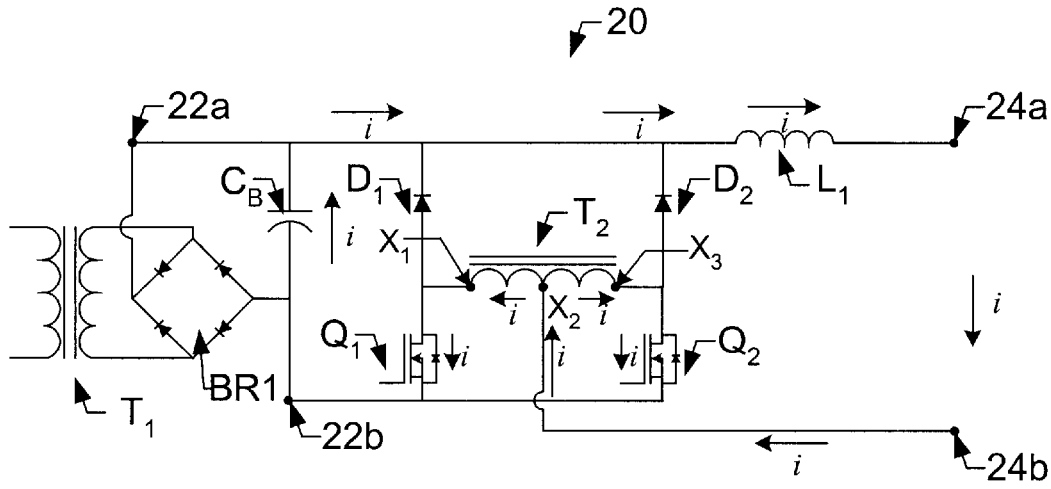

FIG. 3A is an illustration of the current flow in the buck regulator circuit when the switches are operated in a parallel mode according to one embodiment of the present invention.

Figure 3B:
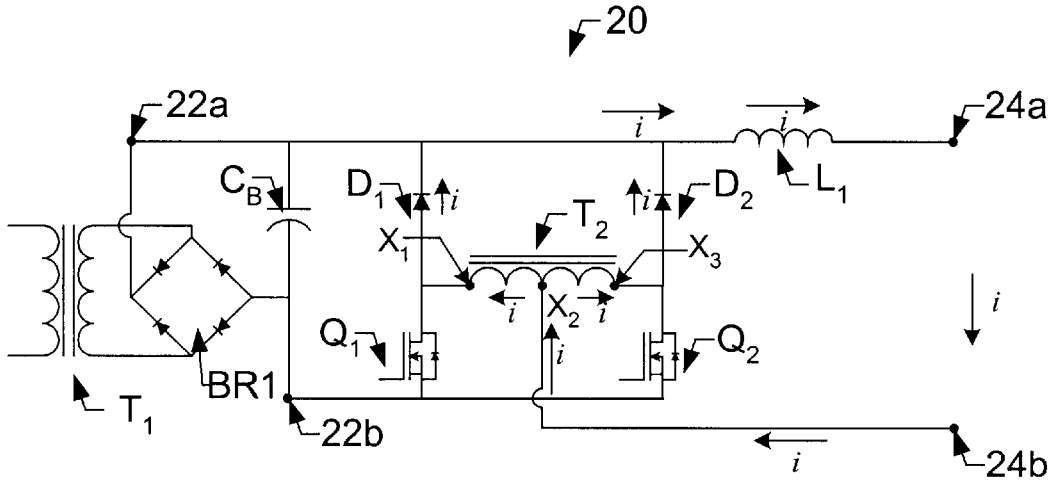

FIG. 3B is an illustration of the current flow in the buck regulator circuit when the switches are both in an "off" state according to one embodiment of the present invention.

Figure 3C:
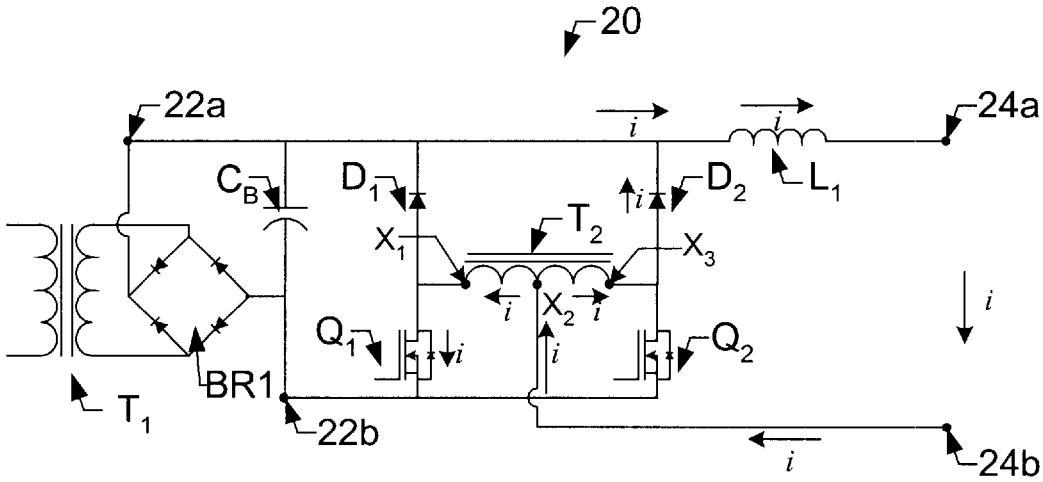
Figure 3D:
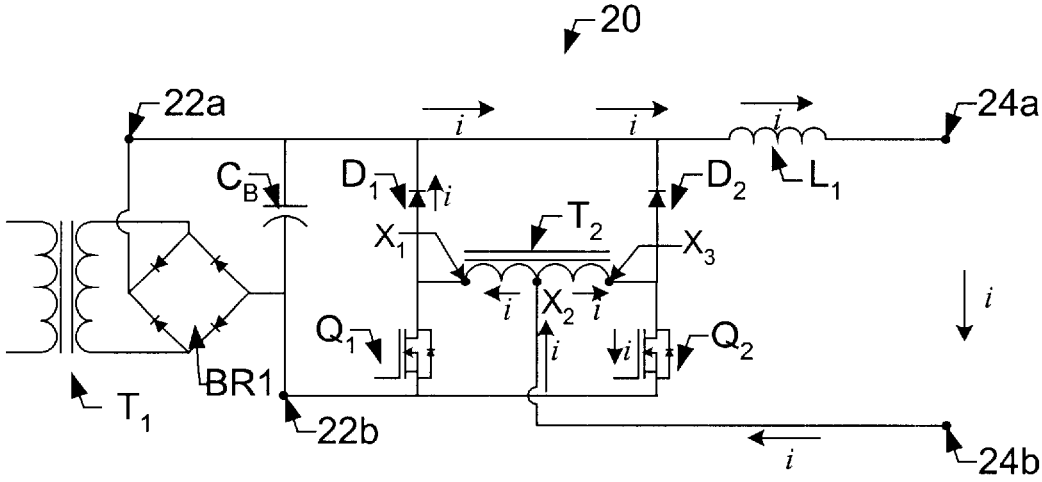

FIGS. 3C and 3D are illustrations of the current flow in the buck regulator circuit when the switches are operated in a push-pull configuration according to one embodiment of the present invention.

Figure 4:
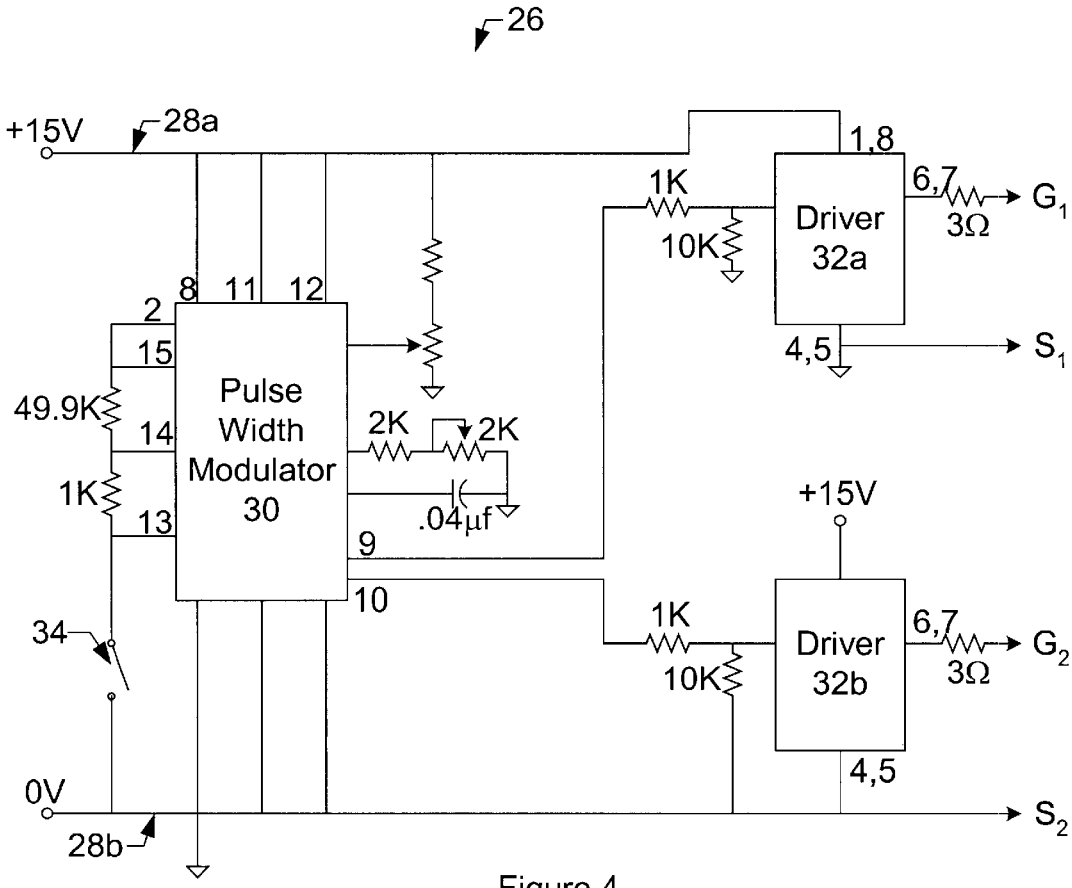

FIG. 4 is a schematic depiction of a control circuit for controlling the switches of the buck regulator according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As mentioned above, the present invention provides a buck regulator circuit that provides two separate voltage outputs for use by machinery connected thereto. Further, the buck regulator circuit of the present invention decreases the current across the switches used in the regulator circuit such that less expensive switches may be implemented in the system.

FIG. 2 illustrates one embodiment of the buck regulator circuit 20 of the present invention. The buck regulator circuit includes positive and negative input terminals, 22*a* and 22*b*, respectively, connected to a rectifier bridge BR1, which, in turn, is connected to a line frequency transformer $T_1$. The transformer is connected to an AC voltage source, such as a wall outlet. The buck regulator circuit 20 further includes positive and negative load terminals, 24*a* and 24*b*, respectively, connected to a load, not shown. The load can be any machinery, control system, etc. requiring regulated DC power. Connected between the positive input and positive load terminals is an inductive element $L_1$.

Importantly, the buck regulator circuit of the present invention includes a center-tapped auto-transformer $T_2$. The center-tapped auto-transformer $T_2$ has an intermediate tap $X_2$ and first and second end taps, $X_1$ and $X_3$, respectively. The intermediate tap of the auto-transformer is connected to the negative load terminal 24*b*. Connected to the first $X_1$ and second $X_3$ end taps of the center-tapped auto-transformer are first and second switches, $Q_1$ and $Q_2$, respectively, and first and second diodes, $D_1$ and $D_2$, respectively. The first switch $Q_1$ is connected between the first end tap $X_1$ of the center-tapped auto-transformer $T_2$ and the negative input terminal 22*b*, and the first diode $D_1$ is connected between the first end tap $X_1$ and the positive input terminal 22*a*. Similarly, the second switch $Q_2$ is connected between the second end tap $X_3$ of the center-tapped auto-transformer $T_2$ and the negative input terminal 22*b*, and the second diode $D_2$ is connected between the second end tap $X_3$ and the positive input terminal 22*a*. In some embodiments, the buck regulator circuit of the present invention may further include a capacitive element $C_1$ connected between the positive and negative input terminals to smooth AC ripple in the circuit.

As mentioned above, the buck regulator circuit of the present invention is capable of operating in two modes, where each mode of operation outputs two different voltage levels. Further, in either mode, the buck regulator circuit reduces the current across the switches used in the circuit. The operation of the buck regulator circuit of the present invention is discussed in greater detail below.

In a first mode, the switches of the buck regulator circuit are operated in parallel. In this mode, the switches, $Q_1$ and $Q_2$, are switched to the same state at substantially the same time, such that both switches are in an "on" state at the same time and in an "off" state at the same time. With reference to FIG. 3A, in the parallel mode, when the switches, $Q_1$ and $Q_2$, are in the "on" state, current flows from the capacitor $C_1$ through the inductive element $L_1$ and the load. From the negative terminal of the load, the current flows through the center tap $X_2$ of the auto-transformer to the first and second ends, $X_1$ and $X_3$. Finally, the current flows through the switches, $Q_1$ and $Q_2$, to the capacitor $C_1$. With reference to FIG. 3B, when the switches, $Q_1$ and $Q_2$, are in the "off" state, the energy stored in the inductive element $L_1$ free wheels through load and the first and second diodes, $D_1$ and $D_2$.

Importantly, in this configuration, because current is flowing in both directions in the auto-transformer $T_2$ (i.e., from $X_2$ to $X_1$ and $X_2$ to $X_3$), there is no net flux in the auto-transformer $T_2$. As such, no transformer action occurs, and the maximum voltage is provided to the load. In this arrangement, the regulator circuit of the present invention operates much like a conventional buck regulator. Importantly, however, because the switches are configured in parallel, the total peak current in the circuit is divided between the two switches, as opposed to flowing through only one switch. For example, if current across the load is 200 amps, then the current across each switch is approximately 100 amps per switch. As such, switches having lower current ratings and typically cheaper in cost can be used in the buck regulator circuit of the present invention.

In addition to operating in the parallel mode to provide a first voltage, the switches of the buck regulator circuit of the present invention can also be operated in a push-pull mode to provide a second lower voltage. In the push-pull mode, the "on" time of the switches is alternated, such that only one switch is in the "on" state at a given time. As only one switch is "on" at a given time, current flows through the auto-transmitter $T_2$ and causes a net flux. The auto-transformer effectively turns down the load voltage through the circuit decreasing the load voltage to a second level and decreasing the current through each switch.

Specifically, with reference to FIG. 3C, during the first cycle of the push-pull mode, the first switch $Q_1$ is in the "on" state. In this instance, current flows from the capacitor $C_1$, through the inductor $L_1$ and load to the auto-transformer $T_2$. In the auto-transformer, the current flows from the center tap $X_2$ to the end tap $X_1$ and from there through the first switch $Q_1$ back to the capacitor $C_1$. By auto-transformer action, the second end tap $X_3$ of the auto-transformer becomes positive relative to the intermediate tap $X_2$. This positive difference causes current to also flow from the second end tap $X_3$ through the second diode $D_2$, inductor $L_1$, load, and back through the intermediate $X_2$ and second end $X_3$ taps of the auto-transformer $T_2$. With reference to FIG. 3B, when the first switch is transitioned to the "off" state and prior to the second switch being transitioned to the "on" state, the energy stored in the inductor $L_1$ free wheels through the load to the intermediate tap $X_2$ of the auto-transformer $T_2$. From the intermediate tap, the current flows through to both the first and second end taps, $X_1$ and $X_3$, the first and second diodes, $D_1$ and $D_2$, and back to the inductive element $L_1$.

With reference to FIG. 3D, after the first switch $Q_1$ has been transitioned to an "off" state, the second switch $Q_2$ is then transitioned to an "on" state. Similar to the operation when the first switch $Q_1$ is "on," load current flows from the capacitance element $C_1$, through the inductive element $L_1$, and the load. From the negative terminal 24B, the current flows to the intermediate tap $X_2$ of the auto-transformer $T_2$, to the second end tap $X_3$, and then the second switch $X_2$ to the capacitor $C_1$.

As current flows in the auto-transformer from the intermediate tap $X_2$ to the second end tap $X_3$, a positive voltage is realized between the first end tap $X_1$ and the intermediate tap $X_2$. The positive voltage causes current to flow from the first end tap $X_1$ through the first diode $D_1$, inductive element $L_1$, the load and through intermediate tap $X_2$ and first end tap $X_1$ of the auto-transformer $T_2$.

With reference to FIG. 3B, when the second switch $Q_2$ is again transitioned to the "off" state and prior to the transition of the first switch to the "on" position, the energy in the inductive element $L_1$ again freewheels. Specifically, the current flows from the inductive element $L_1$ through the load, through the intermediate tap $X_2$ to the first $X_1$ and second $X_3$ taps, the first and second diodes, $D_1$ and $D_2$, to the inductive element $L_1$.

As can be seen in FIGS. 3A–3D, when the first and second switches, $Q_1$ and $Q_2$, are operated in the push-pull mode, there is a net flux flow in the auto-transformer. This causes auto-transformer action, which steps down the voltage across the load providing a second voltage. Further, the auto-transformer also steps down the current through each of the switches when they are in the "on" state. As such, not only does the buck regulator in the push-pull mode provide a second lower voltage output across the load, it also reduces the current across the switches.

In a typical embodiment, the auto-transformer $T_2$ approximately halves the voltage in the push-pull mode to the voltage output and the parallel mode. As such, in one embodiment, the buck regulator of the present invention operates as a 1:1 power source in the parallel mode and a 2:1 step-down power source in the push-pull mode. Further, in both modes the current for each switch is typically halved reducing the required power rating for the switches.

The power loss in the switching elements is an important aspect of the buck regulator circuit of the present invention. When operated in the parallel mode the circuit is functionally the same as a buck regulator with a single large switch, however several advantages still exist. First, a single switch large enough to handle the load current may cost several times that of a smaller switch. Second, as the switches become larger, switching losses limit the maximum frequency at which they can operate.

One possible solution would be to simply parallel two of the smaller switches. This can be done, however, it requires that the switches be matched for both conduction and switching characteristics which may significantly increase cost. If the switches are operated in parallel and not matched for their conduction and switching characteristics, one switch may carry much more current than the other resulting in failure. At the switching frequencies common in this type of regulator, switching losses, and more specifically "turn off" losses can easily become the predominant losses in the system. If not matched for switching characteristics, the slower switch can carry all of the "turn off" losses resulting in failure. In the case of the present invention, if one switch turns "on" or "off," prior to the other, the unbalanced current in the auto-transformer causes a net flux to exist in the transformer. This net flux causes transformer action, which in turn, limits the current in the conducting switch to one half of the load current. As a result of the auto-transformer, no switch can be required to conduct more than one half of the load current.

Although the switches in the push-pull mode have the same "on" time as the one switch $Q_B$ of the conventional buck regulator, the push-pull mode does provide advantages in terms of the inductive element $L_1$. Specifically, output voltage ripple is directly related to the operation of the switch. The frequency of this ripple will determine the voltage loading on the inductive element $L_1$. For example, in the prior art buck regulator circuit 10 illustrated in FIG. 1, if the switch transitions between "on" and "off" states at 25 kHz, the ripple output will have a frequency of 25 kHz and it will load the inductive element $L_1$ at a first rate. However, in the case of push-pull switches, the switches are operated 180° out of phase. If both switches are operating at 25 kHz, then essentially together they operate at 50 kHz, which creates a 50 kHz ripple. The 50 kHz ripple loads the inductive element $L_1$ at a rate that is twice that of the first rate. This effectively allows a smaller, less expensive inductive element $L_1$ to be used in the buck regulator circuit.

Alternatively, if the ripple frequency of the output is to be maintained at 25 kHz, the switching frequency of each switch can be reduced to 12.5 kHz. Since the predominant losses can be switching losses, which are proportional to switching frequency, it is possible to handle significantly higher load current in the alternating mode.

As mentioned, an important advantage of the present invention is the ability to provide two voltage output levels while also reducing the current across the switches used the regulator circuit. The advantages of the buck regulator circuit of the present invention may be beneficial for many different applications. As an example, one embodiment of the buck regulator circuit of the present invention can be advantageously used in a welding or cutting system. In a welding or cutting system, typically a first output voltage is required to initiate the welding or cutting process, but this high voltage level is not required to maintain the cutting or welding process, once initiated. While conventional buck regulators only provide one voltage, (i.e., the high level voltage required to initiate cutting or welding), the buck regulator circuit of the present invention can be used instead to provide an initial high voltage followed by a reduced voltage to sustain the welding or cutting process.

In this embodiment, the positive and negative output terminals, 22*a* and 22*b*, are connected to a rectifier bridge and power transformer that outputs 56 VAC. The positive and negative load terminals, 24*a* and 24*b*, are connected to a welding or cutting system, (i.e., load). In this embodiment, when welding or cutting is initiated, the buck regulator circuit of the present invention operates the switches in a parallel mode and outputs a load voltage of 75 VDC. After welding has been initiated, the switches of the buck regulator circuit of the present invention are transitioned to operate in a push-pull mode. In the push-pull mode, due to the action of the auto-transformer, a voltage of approximately half that of the voltage output in the parallel mode, (i.e., approximately 37.5 VDC) is output across the load. As such, the buck regulator circuit of the present invention provides at least two voltage levels allowing the welding or cutting system to conserve energy in the welding process. Further, due to use of two switches and the auto-transformer, the current through each switch is half that of the load current.

As discussed above, the first and second switches, $Q_1$ and $Q_2$, of the buck regulator circuit of the present invention are controlled to operate in either a parallel mode or a push-pull mode. In typical embodiments, these switches are logic field-effect transistors (FETs), such as J-FETs or MOSFETs, which can be electronically controlled by a controller for precise operation. For example, FIG. 2 illustrates a control circuit 26 connected to the switches. The control circuit controls the "on" and "off" states of the switches.

Although any general circuit may be used for the purpose of controlling the switches, FIG. 4 illustrates an embodiment of a control circuit designed and implemented to test the buck regulator circuit of the present invention. The control circuit 26 includes positive and negative rails, 28*a* and 28*b*, for connection to a voltage source. Further, the control circuit includes a pulse width modulator 30 and two buffer drivers, 32*a* and 32*b*. The buffer drivers each include an output, $S_1$ and $S_2$, respectively, for connection to the source of the switches, $Q_1$ and $Q_2$, and an output, $G_1$ and $G_2$, for connection to the gate of the switches. The pulse width modulator includes a first circuit $P_1$ for adjusting the width of the pulses output by the modulator and a second circuit $P_2$ for adjusting the frequency of the modulator.

Importantly, in one advantageous embodiment, the pulse width modulator 30 is a transistor logic ship TL594. This logic chip includes an enable pin that when enabled outputs pulses to both buffer drivers at the same time to drive the switches in parallel, and when disabled, outputs pulses alternatively to the buffer drivers to drive the switches in a push-pull configuration. A selector switch 34 is provided to alter the mode of the modulator. As such, the buck regulator circuit of the present invention can be operated to provide two separate voltage levels based on the position of the selector switch.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A buck regulator circuit for use in a power supply comprising:

positive and negative input terminals for connection to a power source;

positive and negative load terminals for connection across a load;

an inductive element operably connected between said positive input terminal and said positive load terminal;

an auto-transformer having first and second taps and an intermediary tap, wherein said intermediary tap is operably connected to said negative load terminal;

first and second diodes respectively operably connected between said first and second taps of said auto-transformer and said positive input terminal; and first and second switches respectively operably connected between said first and second taps of said auto-transformer and said negative input terminal, wherein said first and second switches are repeatedly transitioned between on and off states to supply a voltage across the load.

2. A circuit according to claim 1 further comprising a capacitance element operably connected between said first and second input terminals for reducing voltage ripple.

3. A circuit according to claim 1 further comprising a controller connected to said first and second switches to control said switches to transition between on and off states.

4. A circuit according to claim 3, wherein said controller controls said first and second switches to operate in a parallel mode to provide a first voltage across the load.

5. A circuit according to claim 4, wherein said controller in the parallel mode controls said first and second switches to repeatedly switch to the same state at substantially the same time to provide the first voltage.

6. A circuit according to claim 3, wherein said controller controls said first and second switches to operate in a push-pull mode to provide a second voltage across the load.

7. A circuit according to claim 6, wherein said controller in the push-pull mode controls said first and second switches to repeatedly switch to opposite states from each other at substantially the same time to provide the second voltage.

8. A circuit according to claim 1 further comprising a line transformer and bridge rectifier connected to said positive and negative input terminals to provide a rectified voltage from an alternating current source.

9. A buck regulator circuit for use in a power supply comprising:

positive and negative input terminals for connection to a power source;

positive and negative load terminals for connection across a load;

an auto-transformer having first and second taps and an intermediary tap, wherein said intermediary tap is operably connected to said negative load terminal; and a first switch connected between said first tap of said auto-transformer and said negative input terminal; and a second switch connected between said second tap of said auto-transmitter and said negative input terminal, wherein said first and second switches are repeatedly transitioned between on and off states to supply a voltage across the load, and wherein said switches are operated in a parallel mode to provide a first voltage across the load and in a push-pull mode to provide a second voltage across the load.

10. A circuit according to claim 9 further comprising:

an inductive element operably connected between said positive input terminal and said positive load terminal; and first and second diodes respectively operably connected between said first and second taps of said auto-transformer and said positive input terminal.

11. A circuit according to claim 9 further comprising a capacitance element operably connected between said first and second input terminals for reducing voltage ripple.

12. A circuit according to claim 9 further comprising a controller connected to said first and second switches to control said switches to transition between on and off states.

13. A buck regulator circuit for use in a power supply comprising:

positive and negative input terminals for connection to a power source;

positive and negative load terminals for connection across a load;

an auto-transformer having first and second taps and an intermediary tap, wherein said intermediary tap is operably connected to said negative load terminal; and a first switch connected between said first tap of said auto-transformer and said negative input terminal; and a second switch connected between said second tap of said auto-transformer and said negative input terminal, wherein said first and second switches are repeatedly transitioned between on and off states to supply a voltage across the load, wherein when said first and second switches are operated in a parallel mode, the current flowing through the load is divided between said first and second switches.

14. A circuit according to claim 13 further comprising:

an inductive element operably connected between said positive input terminal and said positive load terminal; and first and second diodes respectively operably connected between said first and second taps of said auto-transformer and said positive input terminal.

15. A circuit according to claim 13 further comprising a capacitance element operably connected between said first and second input terminals for reducing voltage ripple.

16. A circuit according to claim 13 further comprising a controller connected to said first and second switches to control said switches to transition between on and off states.

17. A buck regulator circuit for use in a power supply comprising:

positive and negative input terminals for connection to a power source;

positive and negative load terminals for connection across a load;

an auto-transformer having first and second taps and an intermediary tap, wherein said intermediary tap is operably connected to said negative load terminal; and a first switch connected between said first tap of said auto-transformer and said negative input terminal; and a second switch connected between said second tap of said auto-transformer and said negative input terminal, wherein said first and second switches are repeatedly transitioned between on and off states to supply a voltage across the load, wherein when said first and second switches are operated in a push-pull mode, said auto-transformer steps down the voltage provided by the source to the load and the current through the load and said switches when in the on state.

* * * * *